US005419302A

United States Patent [19]

Abe

[11] Patent Number: 5,419,302

[45] Date of Patent: May 30, 1995

[54] METHOD FOR CONTROLLING AIR FUEL RATIO OF AN INTERNAL COMBUSTION ENGINE

[75] Inventor: Kiyomi Abe, Kokubunji, Japan

[73] Assignee: Fuji Jukogyo Kabushiki Kaisha, Tokyo, Japan

[21] Appl. No.: 76,753

[22] Filed: Jun. 15, 1993

[30] Foreign Application Priority Data

Jul. 9, 1992 [JP] Japan ..... 4-182533

[51] Int. Cl.[6] ..... F02M 51/00

[52] U.S. Cl. ..... 123/674

[58] Field of Search ..... 123/674, 399, 698, 520; 364/431.05

[56] References Cited

U.S. PATENT DOCUMENTS 5,080,064 1/1992 Buslepp et al. ..... 123/399
5,243,951 9/1993 Nakaniwa ..... 123/674
5,255,662 10/1993 Nakajima ..... 123/674
5,257,613 11/1993 Monda et al. ..... 123/674
5,297,046 3/1994 Nakaniwa ..... 364/431.05

*Primary Examiner*—Raymond A. Nelli
*Attorney, Agent, or Firm*—Beveridge, DeGrandi, Weilacher & Young

[57] ABSTRACT

A method for controlling air-fuel ratio of an internal combustion engine with an adaptive learning control system. In recent years, as vaporized fuel restrictions are becoming stringent, a large quantity of vaporized fuel purged into an engine has a greater effect on an air-fuel ratio feedback control of an engine. Therefore, a portion originated from the vaporized fuel in the learning data is so much as being unable to be neglected. At an engine start, that portion hampers controlling an engine properly, resulting in adverse effects on emissions and startability.

The present invention provides a method for eliminating such adverse effects by erasing the learning data originated from vaporized fuel exclusively before an engine start.

14 Claims, 11 Drawing Sheets

METHOD FOR CONTROLLING AIR FUEL RATIO OF AN INTERNAL COMBUSTION ENGINE

BACKGROUND OF THE INVENTION

The present invention relates to a method for controlling the air-fuel ratio of an internal combustion engine such as an automotive engine and more particularly to a method of controlling the air-fuel ratio of an engine at a time when vaporized fuel in the fuel tank is purged into an engine.

As is well known, in the air-fuel control for a conventional engine, a learning control system has been introduced so as to correct a deviation of the air-fuel ratio derived from production variations or deteriorations in components such as an induction air flow sensor, a fuel injector and other components as quickly as possible and so as to keep the air-fuel ratio at a desired value even when the engine operating condition is largely changed. That is to say, at the previous running of the engine, a deviation of the centerline for the so-called LAMDA control coefficient is memorized on a map and at the present running, fuel injection amount is corrected by referring to the deviation memorized on the map, whereby the air-fuel ratio is controlled properly.

However, in recent years, restrictions have been placed on the releasing of vaporized fuel in the fuel tank to the atmosphere because of air pollution. To prevent the emission of the vaporized fuel, a so-called evaporative emission control system is widely used, wherein vaporized fuel in the fuel tank is adsorbed in a charcoal canister and then the vaporized fuel adsorbed therein is discharged into an induction system of an engine together with air. In this reference the discharging referred to as "canister purging" or "canister purge". When a canister purge is carried out, commonly, the air-fuel ratio is deviated depending upon the amount of purged fuel being introduced into the engine. The deviation caused by the canister purge is learned as a deviation amount of the centerline for the LAMDA control coefficient and the map is rewritten by the above new learned data, whereby thereafter air-fuel ratio is adjusted as much as said deviation amount and is so controlled as to bring the deviated air-fuel ratio back to a desired value.

The problem is that when an engine is stopped and next started, adverse effects on engine startability and emissions are brought about, because the previously learned data are used even in an open loop control at an engine start and as a result, air-fuel ratio is substantially deviated.

To solve this problem, Japanese patent application laid open No.1988-129159 discloses a technology to control an opening/closing means which is disposed at a purging passageway for inducting vaporized fuel generated in the fuel tank into the induction system of an engine in such a way as the purging passageway is opened or closed with a specified interval based on the engine operating condition and to renew a learned value for the fuel amount in mixture gas based upon the detected air-fuel ratio when the purging passageway is closed, i.e., canister purge is inoperative.

However, in this prior art, a means for renewing a learned value only when a canister purge is stopped has a disadvantage that no correction is made to secular changes (deteriorations) or variations of components when canister purge is conducted, resulting in degraded controllability of the system.

SUMMARY OF THE INVENTION

It is an object of the present invention to provide a method for eliminating deviation of air-fuel ratio adaptive learning values derived from canister purging so as to be able exclusively to use basic adaptive learning values derived from secular changes or variations of components, thereby improving the controllability of the system.

According to the present invention, there is provided a method for controlling air-fuel ratio of an internal combustion engine having a learning control method in the feedback control system in order to control air-fuel ratio correctly under any engine operating conditions.

The method comprises the steps of, obtaining variations for an air-fuel ratio feedback correction coefficient by varying the amount of fuel vapor purged into an engine for a specified time when the engine is in the steady operating condition, calculating deviations of air-fuel ratio learning values derived from above purged fuel vapor based upon said variations of the air-fuel ratio feedback correction coefficient, and rewriting the previous air-fuel ratio learning values with the new air-fuel ratio learning values by subtracting said amount of deviations after an engine stop.

In summary, according to the present invention a good startability, a smooth running and a steady emissions performance are provided by means of correcting air-fuel ratio feedback correction coefficients under any operating conditions, and more particularly, at an engine stop, rewriting the air-fuel ratio learning values with the values excluding a deviation originated from canister purging and further at an engine start where no canister purging is performed, by means of using a renewed adaptive learning map not effected by canister purging at the previous running.

DETAILED DESCRIPTION OF PREFERRED EMBODIMENTS

Figure 9:
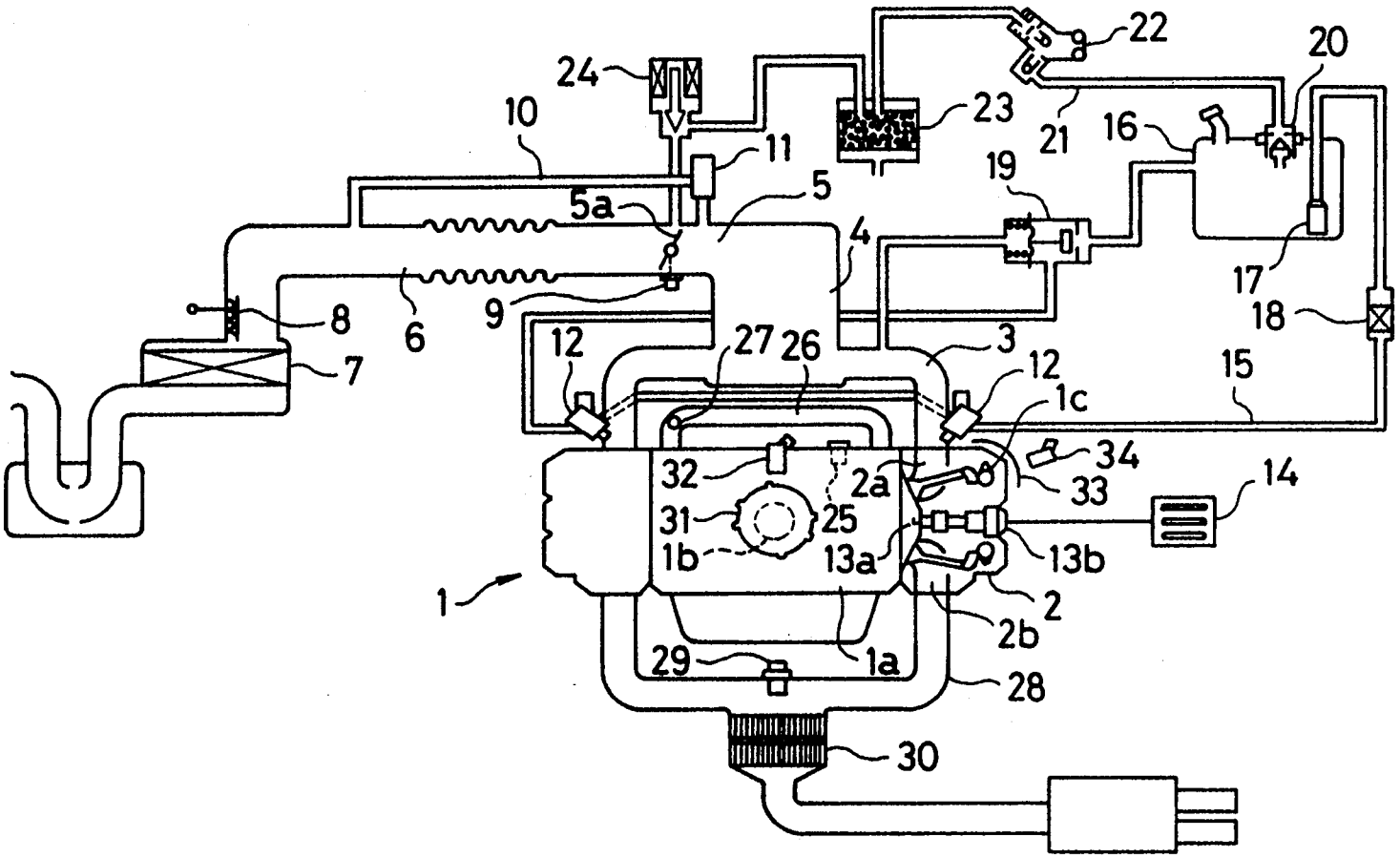
FIG. 9 is a schematic diagram showing of the engine control system.

Referring to FIG. 9, reference numeral 1 denotes an engine. In this reference, the engine illustrates a horizontally opposed four cylinders engine. An intake port 2*a* is incorporated in a cylinder head 2 of the engine. An intake manifold 3 is mounted on the cylinder head 2 and connected to the intake port 2*a*. A throttle chamber 5 is communicated with the intake manifold 3 via an air chamber 4. An air cleaner 7 is provided upstream of the throttle chamber 5 through an induction conduit 6. Right downstream of the air cleaner 7, an air flow sensor (in this reference a hot wire type of air flow sensor) is provided and further a throttle sensor 9 is connected with a throttle valve 5*a* installed in the throttle chamber 5. An idle speed control (ISC) valve 11 is disposed at a bypass passage communicating between the upstream and the downstream of the above throttle valve 5*a* and a fuel injector 12 is arranged right upstream of the induction port 2*a* for each cylinder. A spark plug 13*a* per each cylinder is provided with its tip protruding into a combustion chamber and an igniter 14 is connected to an ignition coil 13*b* communicating with a spark plug 13*a*. The fuel injector 12 communicates with a fuel tank 16 via a fuel supplying system 15. In the fuel tank 16, a fuel pump 17 (in this embodiment an intank type) is installed. Fuel pressurized by the fuel pump 17 is fed to the fuel injector 12 and a pressure regulator 19 via a fuel filter and is regulated to a specified pressure by the pressure regulator 19, returning to the fuel tank 16. On the fuel tank 16 a fuel cut valve 20 composed of a float valve is installed and a fuel vapor passageway 21 is extended from the fuel cut valve 20. In this fuel vapor passageway a roll-over valve 22 in which two ball type valves and a 2-way valve are integrated is equipped and communicates with a canister 23 having an adsorving substance such as activated charcoal therein. Furthermore, this canister is communicated to the induction system of the engine (right downstream portion of the throttle valve) through a canister purge control (CPC) valve 24 which is composed of a linear solenoid valve.

The fuel vapor generated in the fuel tank 16 is discharged into the fuel valve passageway after a liquid portion of the vaporized fuel is separated by the fuel cut valve 20. When the pressure of the discharged fuel vapor exceeds a determined value of the 2-way valve in the roll-over valve 22, the fuel vapor is adsorbed in the activated charcoal of the canister 23 via the 2-way valve. The fuel vapor stored in the canister 23 is conducted to the induction system via the above CPC valve 24 and inhaled into a combustion chamber of the engine. The CPC valve 24 abovementioned is controlled according to the duty ratio signal transmitted from an electronic control device 41 mentioned hereafter and in this embodiment the valve opening of the CPC valve 24 designed to become large with an increase of the duty ratio.

The abovementioned roll-over valve acts as a safety device to prevent fuel leakage from the fuel tank 16 by means of two ball valves in case of a roll-over accident of a vehicle and also acts as a means for protecting the fuel tank 16 from being deformed by a vacuum pressure, namely, the pressure in the fuel tank is kept within a specified range by a breathing operation of the roll-over valve wherein fuel vapor is released to the canister when the pressure in the fuel tank is above a set pressure and it is conducted into the fuel tank when the pressure in the fuel tank becomes below a set pressure.

There are provided a knock sensor 25 on a cylinder block 1a of the engine 1 and a coolant temperature sensor 27 with its tip exposed in coolant passage 26 which communicates with the right and left banks of the cylinder block 1*a*. Further, an oxygen ($O_2$) sensor 29 and a catalytic converter 30 are equipped at the fork portion of an exhaust manifold 28.

A crank rotor 31 is coupled coaxially with a crank shaft 1*b* mounted on the cylinder block la and on the periphery of the crank rotor 31 a plurality of projections (or slits) are provided. A crank angle sensor 32 (an electromagnetic pick up type in this reference) to detect crank angles is provided against these projections. Further, a cam angle sensor 34 (an electromagnetic pick up type in this reference) for discriminating cylinder numbers is provided against a cam rotor 33 which is connected coaxially with a cam shaft 1*c*. The abovementioned crank angle sensor 32 and the cam angle sensor 34 may be an optical type, and not limited to an electromagnetic type.

Figure 10:
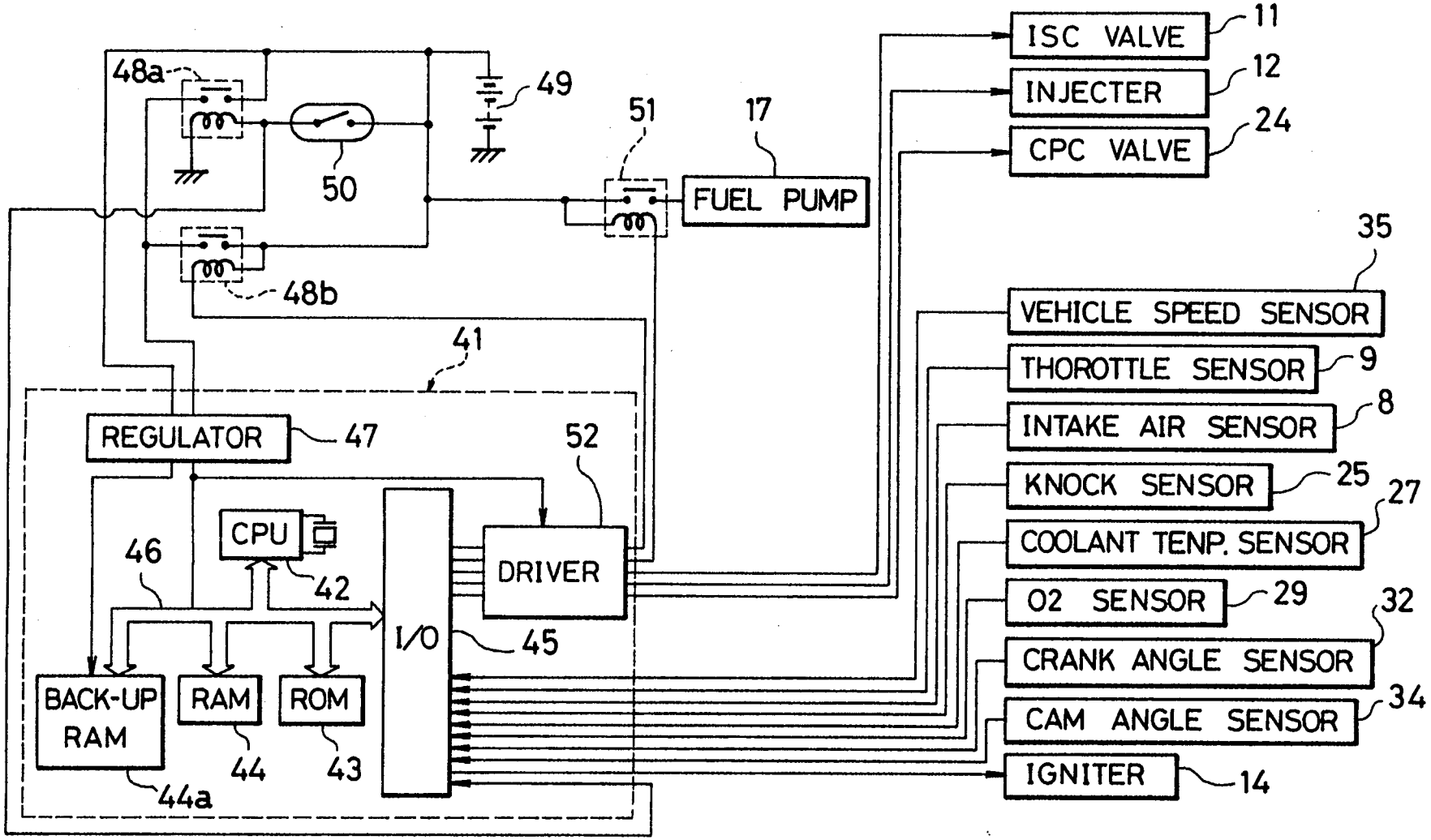
FIG. 10 is a diagrammatic view of the electronic control system.

On the other hand, referring to FIG. 10, a reference numeral 41 denotes an electronic control unit (ECU) in which there are provided a CPU 42, a ROM 43, a RAM 44, a backup RAM 44*a*, an I/O interface 45 and a bus line 46 which connects all together. A reference numeral 47 shows a regulator to supply a specified constant voltage to the ECU. The regulator 47 is connected to a battery 49 via the relay contact point of an ECU relay 48*a* and a self-shut relay 48*b* (power holding relay) respectively whose relays both are arranged in parallel. These relays are provided for supplying power to the ECU 41 when either the ECU relay 48*a* or the self-shut relay 48*b* closes its contact. The battery 49 is connected to a relay coil of the ECU relay 48*a* via an ignition key switch 50 and further connected to a relay coil of a fuel pump relay 51 through which a fuel pump 17 is connected. The above self-shut relay 48*b* is turned "ON" by the ECU 41, where the ignition key switch 50 is turned on and it is kept "ON" by the ECU 41 until exceeding a predetermined time. Namely, the ECU is supplied with electric power for a predetermined time even after the ignition switch is turned off and an engine is stopped in order to carry out miscellaneous processes such as letting flags escape into the backup RAM 44a or rewriting an air-fuel ratio learning value map.

There are provided an air flow sensor 8, a throttle sensor 9, a knock sensor 25, a coolant temperature sensor 27, an $O_2$ sensor 29, a crank angle sensor 32, a cam angle sensor 34 and a vehicle speed sensor 35 in the input port of the above I/O interface 45. The battery voltage is always monitored. Furthermore, an igniter 14 is connected to the output port of the I/O interface 45 and an ISC valve 11, a fuel injector 12, a CPC valve 24 and the relay coil of a fuel pump relay 51 are also connected to the output port of the I/O interface 45 through a driver 52.

In the ROM 43 a control program and miscellaneous fixed control data such as maps are stored and in the RAM 44, data-processed output signals from the sensors and switches abovementioned and miscellaneous data computed by the CPU 42 are stored.

In the backup RAM 44*a*, an air-fuel ratio learning values map and trouble codes corresponding to failed components detected by a self-diagnostic function are stored and these stored data are held therein even after power supply to the ECU 41 has been turned off.

According to the control program stored in the ROM 43, the CPU 42 calculates fuel injection amounts, ignition timings, duty ratios based on signals applied to the driver of the ISC valve 11 and performs miscellaneous controls such as the air-fuel ratio adaptive learning control, the ignition timing control, the idle speed control and the canister purge control. Hereunder, an operation associated with the air-fuel ratio control will be explained.

Figure 3:
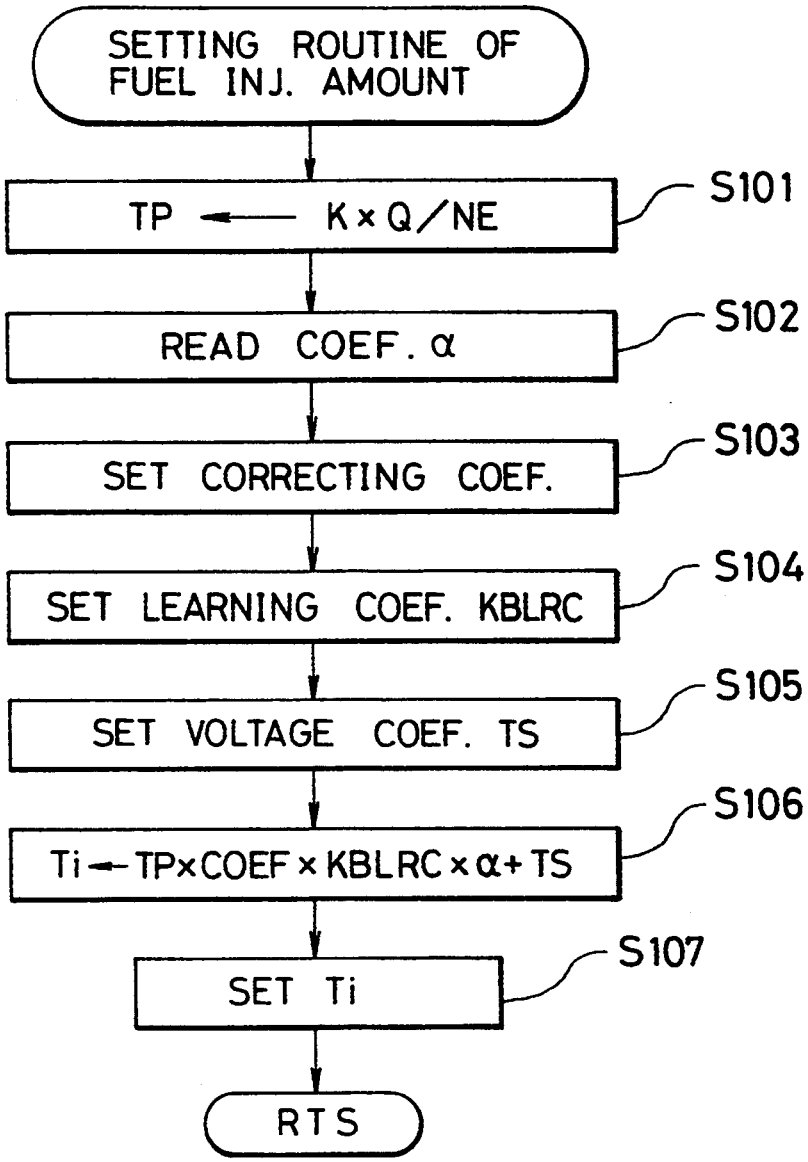
FIG. 3 is a flowchart showing a setting routine of fuel injection amount.

FIG. 3 illustrates a routine for determining fuel injection amounts which is repeated at a set interval (time). At a step S101 a basic fuel injection amount $T_p$ is calculated according to the engine speed $N_E$ derived from output signals of the crank angle sensor 32 and the induction air amount Q based on output signals of the air flow sensor 8 ($T_p=K\times Q/N_E$; where K is a characteristic correction coefficient of fuel injector) and at a step S102 an air-fuel ratio feedback correction coefficient $\alpha$ stored at a fixed address of the RAM 44 is read.

At the next step S103, miscellaneous increment coefficients COEFs such as a coolant temperature correction, acceleration/deceleration corrections, a WOT (wide open throttle) correction and an after-idle correction are determined based on the coolant temperature $T_W$ sensed by a coolant temperature sensor 27, the throttle opening angle $\theta$ sensed by a throttle sensor 9 and the idle position signal sensed by said throttle sensor, and the process goes to a step S104.

At the step S104, an air-fuel ratio learning value $K_{LR}$ is searched on an air-fuel ratio learning value map $TB_{KLR}$ parameterizing an engine speed $N_E$ and a basic fuel injection amount $T_p$ in the backup RAM and an air-fuel ratio learning correction coefficient $K_{BLRC}$ is determined according to interpolation, and then at a step S105, a voltage correction coefficient $T_S$ for correcting an invalid injection duration of the fuel injector 12 is determined based upon a terminal voltage $V_B$ of the battery 49.

Next, at a step S106 a fuel injection amount (a fuel injection pulse duration) $T_i$ is finally determined using miscellaneous coefficients obtained at the abovementioned steps S101, S102, S103, S104 and S105 according to the following formula:

$$T_i=T_p\times COEF\times K_{BLRC}\times\alpha+T_S$$

This pulse duration $T_i$ is set at a step S107 and the routine goes back to the main routine.

Thus, a pulse signal of pulse duration $T_i$ is transmitted from the driver 52 to an injector 12 of each cylinder with a determined timing and the amount of fuel corresponding to the pulse duration Ti is injected.

Figure 4:
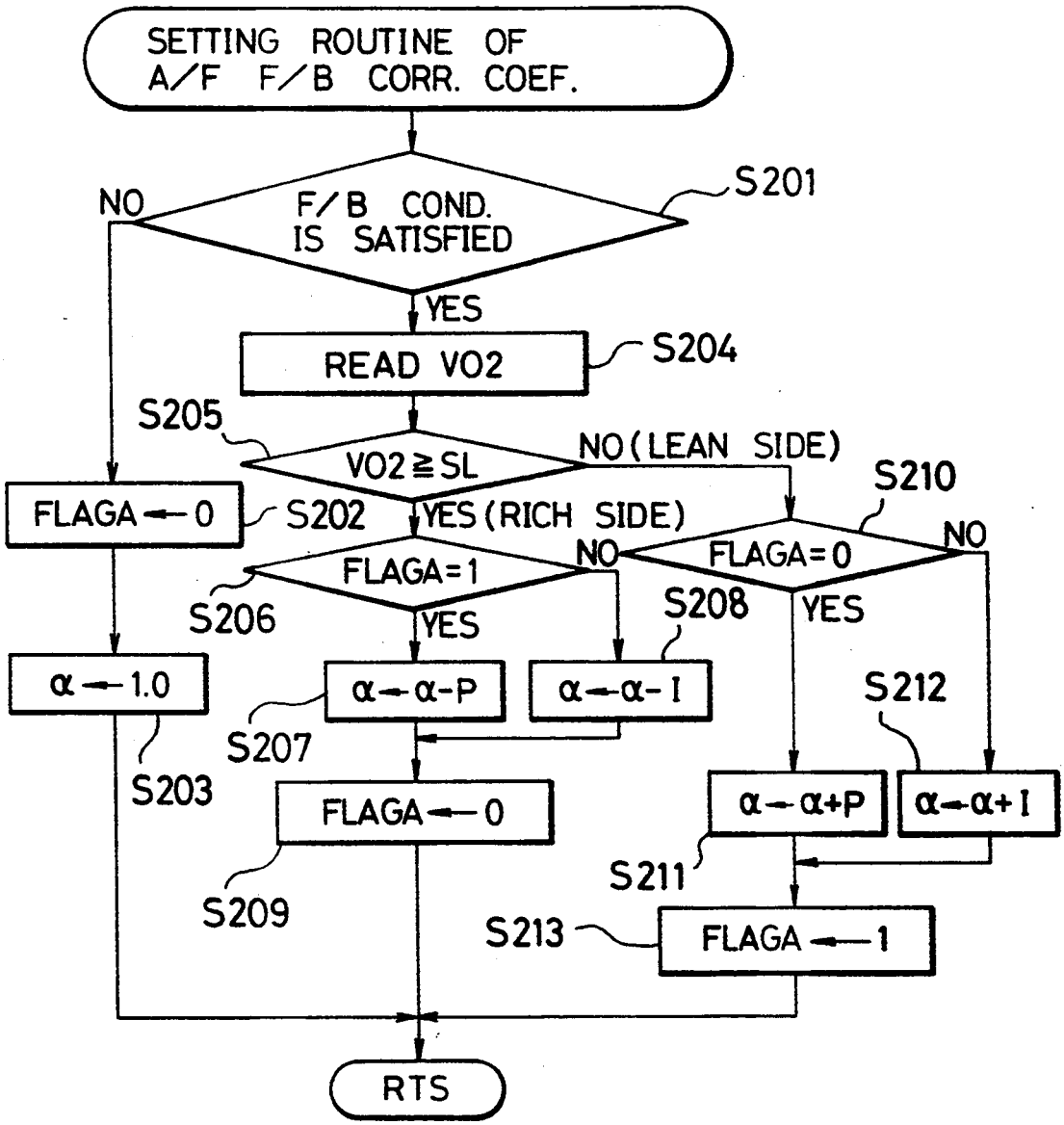
FIG. 4 is a flowchart showing a setting routine of air-fuel ratio correction coefficients.

FIG. 4 shows a setting routine of the air-fuel ratio feedback correction coefficient $\alpha$.

In this routine, at a step 201 it is judged whether or not a feedback control condition is satisfied based on miscellaneous factors indicating the engine operating conditions such as an engine speed $N_E$, a coolant temperature $T_W$ and a basic fuel injection amount $T_p$. For example, a feedback control condition is judged not to be satisfied either in case of the coolant temperature $T_W$ below a specified value (below 50° C. for instance, or in case of the engine speed $N_E$ above a specified value (above 5200 rpm for instance), or in case of the basic fuel injection amount $T_p$ above a specified value (a WOT zone for instance). In cases other than these, the feedback control condition is judged to be met if or when the $O_2$ sensor is activated (an output voltage of the $O_2$ sensor exceeding a specified value).

At the step S201, if it is judged that the feedback control condition is not satisfied, the process goes to a step S202 where a flag $FLAG_A$ for discriminating a switching of air-fuel ratio "rich to lean" or "lean to rich" is cleared ($FLAG_A=0$). Then at the next step S203, the air-fuel ratio feedback correction coefficient $\alpha$ is set to 1.0 and the routine returns to the main routine. That is to say, in a case where the feedback control condition is not satisfied, the air-fuel ratio control becomes a so-called open loop control.

On the other hand, if it is judged that the feedback control condition is satisfied, the process goes to a step S204 where an output voltage of the $O_2$ sensor 29, $V_{O2}$, is read and at a next step S205 it is judged if the present air-fuel ratio is on a rich side or a lean side by comparing the $V_{O2}$ with a set slice level SL.

If at the above step S205 it is judged that $V_{O2}$ is equal to or larger than SL, the process steps to a step S206 where a flag $FLAG_A$ is looked up. The flag $FLAG_A$ is changed from 1 to 0, where air-fuel ratio moves from "lean" to "rich" and the flag $FLAG_A$ is changed from 0 to 1, where the air-fuel ratio transfers from "rich" to "lean".

If $FLAG_A$ is 1 at the above step S206, this indicates that the air-fuel ratio has been in the rich condition, so at a next step S207 the air-fuel ratio feedback correction coefficient $\alpha$ is reduced by a proportional constant P ($\alpha=\alpha-P$) and then at a step S209 $FLAG_A$ is made clear ($FLAG_A=0$), thus the routine returns to the main routine.

If $FLAG_A$ is 0 at the step S206, this case indicates that the air-fuel ratio feedback correction coefficient $\alpha$ has been already reduced by P, so the process goes to a step S208 where the $\alpha$ is reduced by an integral constant I ($\alpha=\alpha-I$), then the routine returns to the main routine after $FLAG_A$ is made clear ($FLAG_A=0$) at the step S209.

If at the step S205 it is judged that $V_{O2}$ is smaller than SL, i.e., the air-fuel ratio is on the lean side, the process goes to a step S210 where it is judged whether the abovementioned $FLAG_A$ is set. If $FLAG_A$ is 0 at the step S210, the air-fuel ratio feedback correction coefficient $\alpha$ is increased by the proportional constant P($\alpha=\alpha+P$) at the next step S211 and if $FLAG_A$ is 1 at the step S210, i.e., the air-fuel ratio feedback correction coefficient $\alpha$ has been increased by the proportional constant P, the process is diverted to a step S212 where $\alpha$ is increased as much as an integral constant ($\alpha=\alpha+I$). Then, the process goes to a step S213 at which $FLAG_A$ is set to 1 ($FLAG_A=1$) and the routine returns to the main routine.

Figure 5:
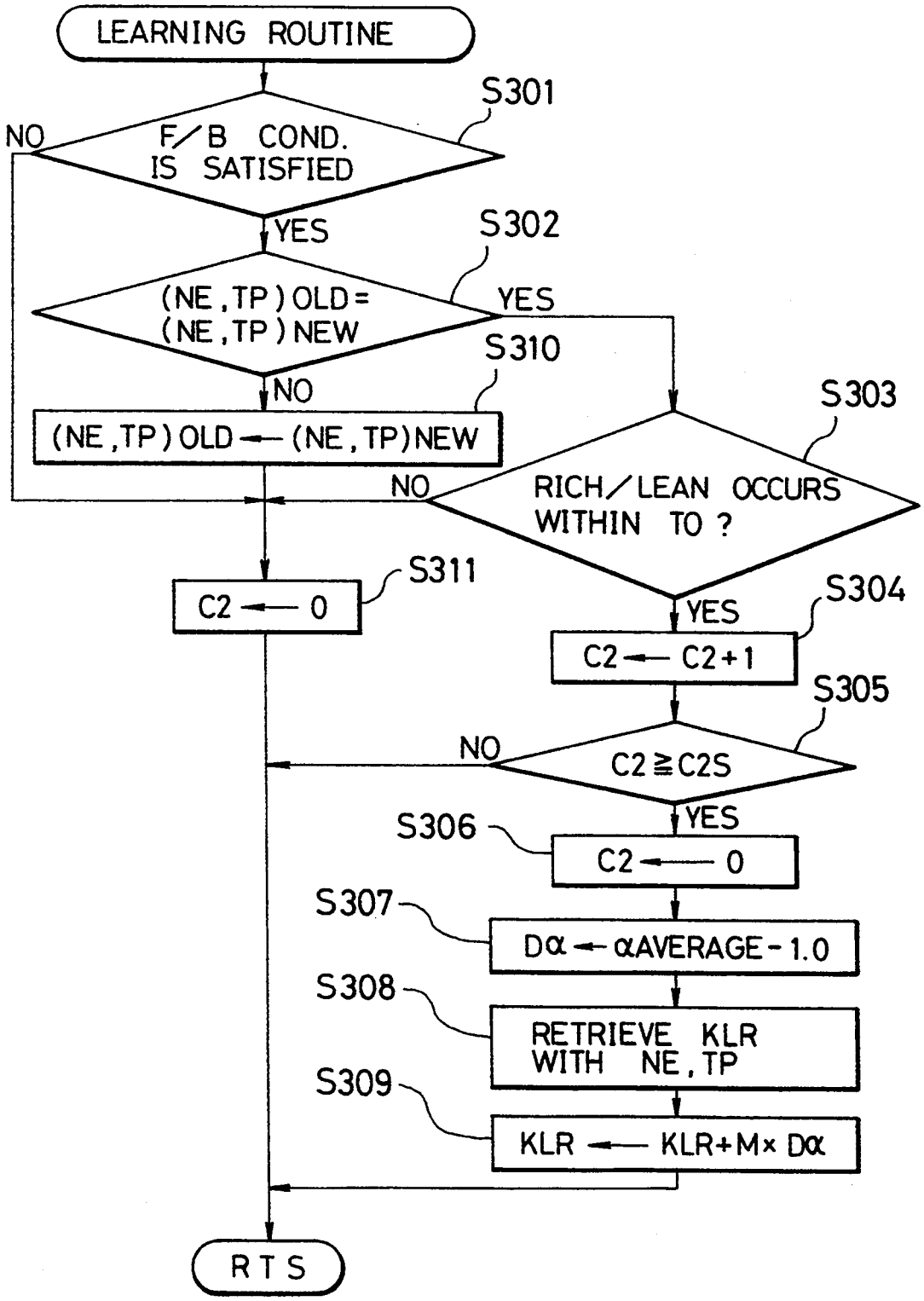
FIG. 5 is a flowchart showing a learning routine.
Figure 12:
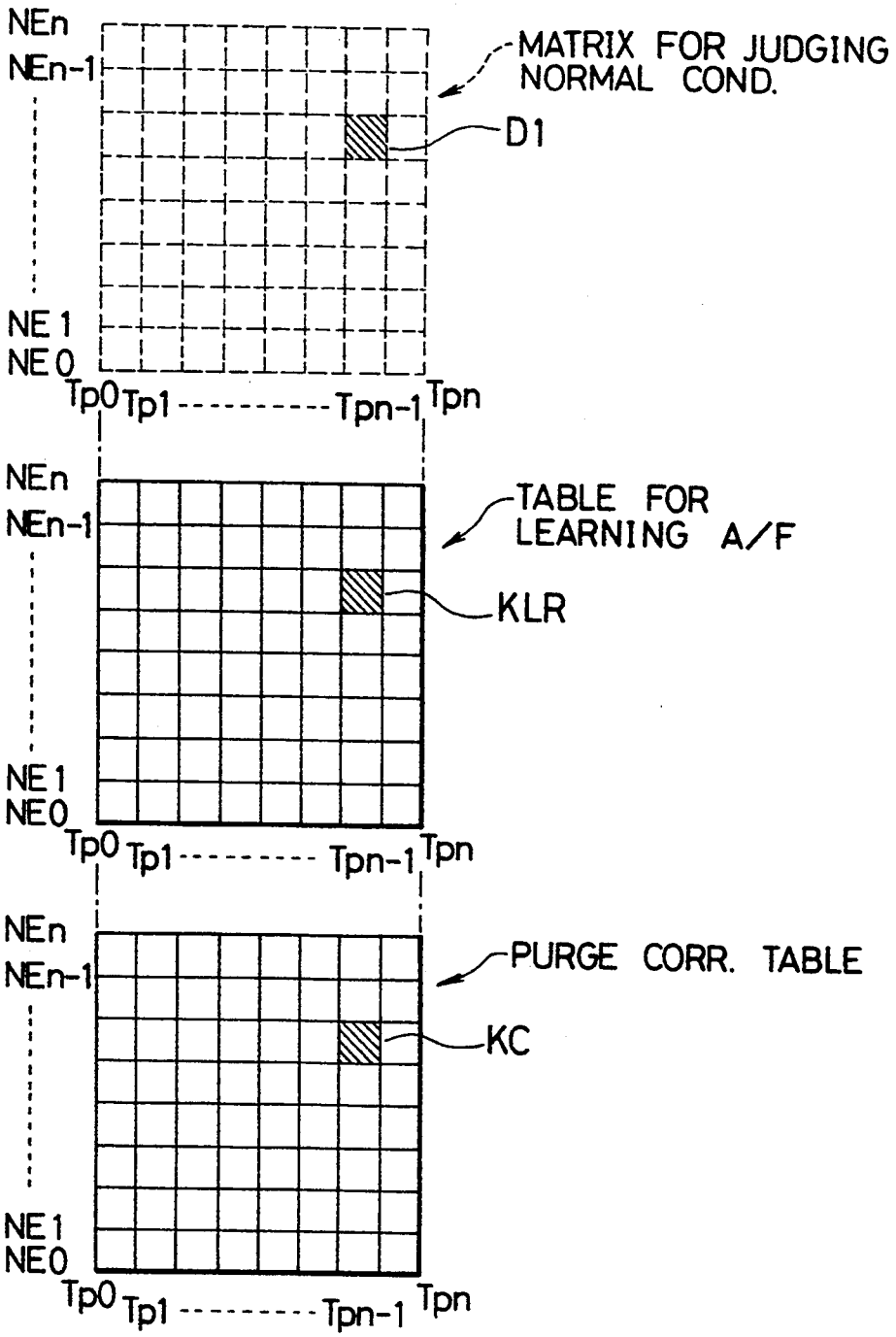
FIG. 12 is an illustrated diagram showing relationships among a matrix for judging steady operating condition, a map for learning air-fuel ratio and a map for purge correction.

FIG. 5 shows a learning routine. At a step S301 where it is judged whether or not the process is in the feedback control, if the process is judged not in the feedback control, the process passes to a step S311 and if it is in the feedback control, the process goes to a step S302. At S302 an area D1 is specified from a matrix MT for judging an operating condition (steady or changing) of an engine as shown in FIG. 12 using the present engine speed $N_E$ and the present basic fuel injection pulse duration $T_p$.

The area data $(N_E, T_p)_{NEW}$ of the area D1 is compared with the area data $(N_E, T_p)_{OLD}$ determined in the previous routine and stored in a RAM 44.

At the step S302, if the new area data $(N_E, T_p)_{NEW}$ is different from the previous area data $(N_E, T_p)_{OLD}$, that is to say, where the routine is an initial one or where the present operational area is not the same as the previous one, which means that an engine is not in the steady operating condition, the process goes from the step S302 to the step S310 where the previous area data ($N_E$, $T_p)_{OLD}$ is updated with the present one ($N_E$, $T_p)_{NEW}$. The updated data is stored in the RAM 44.

At a step S311 a count number C2 (described hereinafter) for counting how many times "rich" to "lean" switchings have been performed is cleared (C2=0), thus the routine terminates.

On the other hand, at the step S302, if the new area data ($N_E$, $T_p)_{NEW}$ is the same as the previous area data ($N_E$, $T_p)_{OLD}$, the process goes to a step S303 where an output voltage $V_{O2}$ of an $O_2$ sensor 29 is read and it is judged whether the $V_{O2}$ is moving between "rich" and "lean" within a specified time $T_O$, namely, air-fuel ratio is switched from "rich" to "lean" or vice versa. In case where there is no switching from "rich" to "lean" or vice versa in the output voltage $V_{O2}$ of the $O_2$ sensor 29, this flow of control goes back to the main routine through the step S311.

On the other hand, in a case where there occurs said switching in the $V_{O2}$ within said time $T_O$, the process goes to a step S304 where the aforementioned count number C2 is counted up by 1 (C2=C2+1).

At the next step S305 it is judged whether or not the above C2 exceeds a predetermined value $C2_S$ (3 for example). If C2 is smaller than $C2_S$, it is judged that an engine is not in the steady operational condition and the routine terminates. If C2 is equal to or greater than $C2_S$, i.e., the engine operating condition represented by an engine speed $N_E$ and basic fuel injection amount $T_p$ is approximately the same and further the output voltage $V_{O2}$ of the $O_2$ sensor 29 has been switched more than $C2_S$ times, it is judged that an engine is in the steady operational condition, then the count number C2 is cleared (C2=0) at a step S306.

Next, the process goes to a step S307 at which an average value $\alpha_{average}$ of a maximum value and a minimum value of the air-fuel ratio feedback correction coefficient $\alpha$ while the output voltage $V_{O2}$ crosses a slice level $C2_S$ times is obtained and then from said $\alpha_{average}$ and a standard value $\alpha_0$ (1.0), a deviation $D\alpha$ is calculated ($D\alpha=\alpha_{average}-1.0$).

At a next step S308 a learning value $K_{LR}$ is searched from an air-fuel ratio learning value map $TB_{KLR}$ in the backup RAM 44*a* parameterizing an engine speed $N_E$ and a basic fuel injection amount $T_p$ and the process goes to a step S309 where, according to the learning value $K_{LR}$ searched as above and the deviation $D\alpha$ calculated as above, a new learning value $K_{LR}$ is determined ($K_{LR}=K_{LR}+M\times D\alpha$; where M is a constant for determining a renewal rate of a learning value) and then a previous learning value $K_{LR}$ in a given address is renewed by said new learning value, thus the routine goes back to the main routine.

Figure 6:
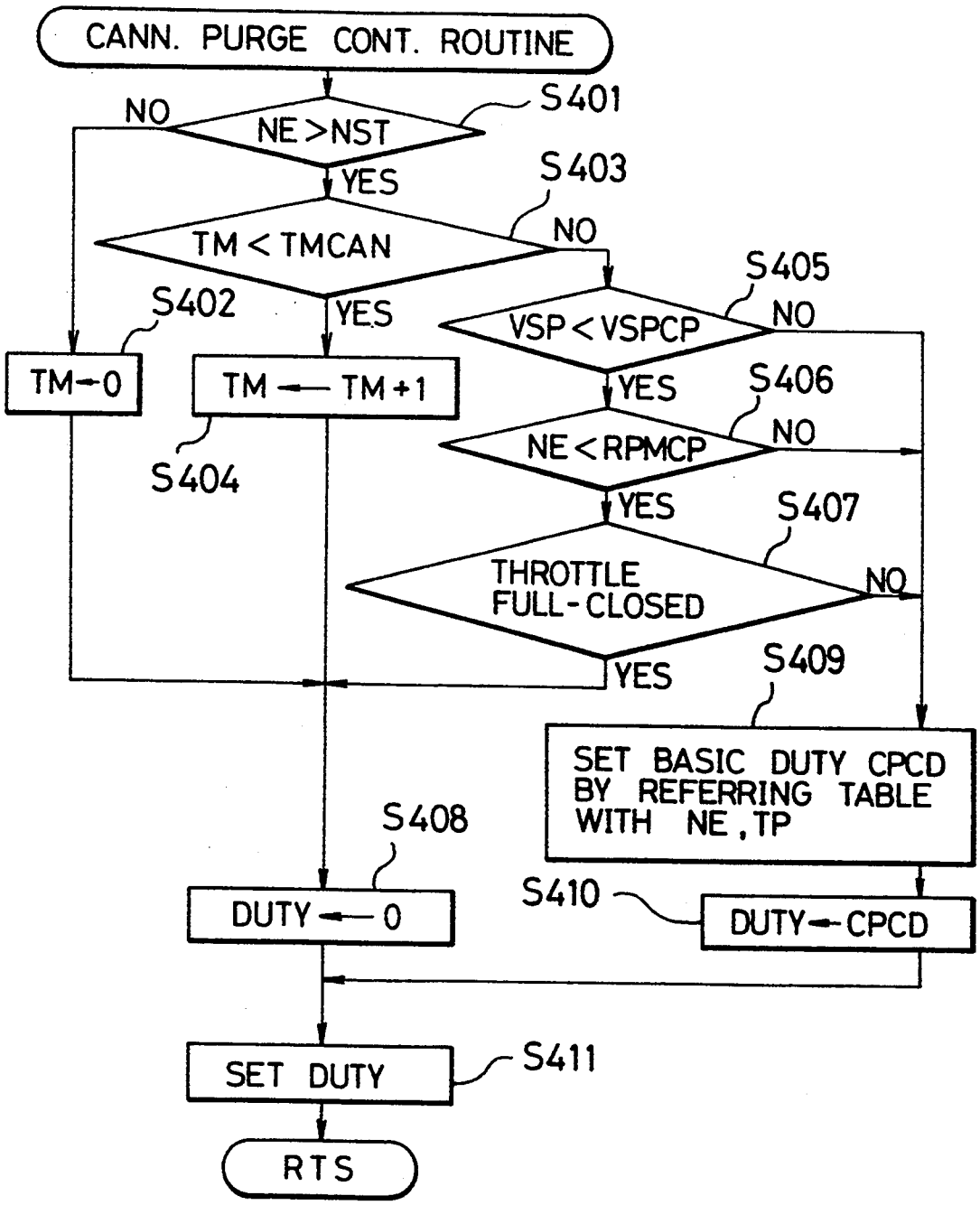
FIG. 6 is a flowchart showing a control routine of canister purging.

During the air-fuel control by routines mentioned above, a canister purge control routine for purging fuel vapor from a canister 23 to an induction system of an engine is carried out by an interruption with a predetermined time interval as shown in FIG. 6.

In this canister purge control routine, first, at a step S401 it is judged whether or not firing of an engine has been completed. If an engine speed $N_E$ is equal to or smaller than a set engine speed $N_{SET}$ (300 to 500 rpm for instance) which indicates a firing completion, it is judged that an engine is not yet in a firing operation and the process goes to a step S402 where a count value TM for counting an elapsed time since firing of engine is made clear (TM=0).

On the other hand, at the above step S401, if $N_E$ is greater than $N_{SET}$, it is judged that an engine is in a firing operation and the process steps to a step S403. At the step S403 the count value TM is compared to a set value TMCAN (corresponding to 63 seconds for instance). If TM is smaller than TMCAN, the count value TM is counted up at the next step S404 and the process goes to a step S408. If TM is equal to or larger than TMCAN, it is judged whether or not an engine is in an idle condition at steps S405, S406 and S407. That is to say, at the step S405 a vehicle speed VSP is compared with a predetermined vehicle speed VSPCP (for example 4 km/h). In case where VSP is smaller than VSPCP, the process goes to a step S406 where an engine speed $N_E$ is compared with a set value RPMCP (for example 1000 rpm).

If $N_E$ is smaller than RPMCP, it is judged whether or not a throttle valve is fully opened.

At abovementioned steps S405, S406 and S407, in a case where a vehicle speed VSP is lower than a set vehicle speed VSPCP and an engine speed $N_E$ is lower than a set value RPMCP and a throttle valve is closed, then it is judged that an engine is in an idle condition and the process goes to a step S408.

At the step S408, a duty ratio for the driving signal of the CPC valve 24, DUTY <hereinafter referred to a purge control duty) is set to 0 (DUTY=0) and then at a step S411, DUTY is set to a driving signal of the CPC valve, thus the flow goes out from this routine. Namely, the CPC valve is provided to be closed so as not to perform a canister purge until a predetermined time elapses since an engine start or during an idle state of an engine.

On the other hand, if a vehicle speed VSP is equal to or above a set vehicle speed VSPCP at the above step S405, or if it is judged that an engine speed $N_E$ is equal to or greater than a set value RPMCP at the above step S406, or if it is judged that a throttle valve is not closed, it is judged that an engine is not in an idle condition and the process goes to a step S409.

At the step S409, a basic duty CPCD is determined by referring a basic duty map in the ROM 43 based on a engine speed $N_E$ and a basic fuel injection pulse duration $T_p$ as an engine load (an updated fuel injection amount $T_i$ or an intake air amount Q may be used). The above basic duty map is, for example, a lattice of 8×8 in which optimum values of the purge control duty DUTY parameterizing an engine speed $N_E$ and a basic fuel injection amount $T_p$ are stored as a basic duty CPCD. These optimum values of the purge control duty have been obtained by experiments or other means separately.

After that the process goes from a step S409 to a step S410 where a purge control duty DUTY is updated with the basic duty CPCD as determined at the above step S409 and the routine returns to the main routine.

When a canister purge is carried out according to the abovementioned routine, the air-fuel ratio is changed and as a result, an air-fuel ratio feedback correction coefficient $\alpha$ determined at the aforementioned routine deviates from the standard value $\alpha_0$ ($\alpha_0=1.0$). This deviation is learned in a steady operational condition of an engine and an air-fuel ratio learning value $K_{LR}$ on the map $TB_{KLR}$ is renewed according to the aforementioned learning routine.

An object of this renewal of $K_{LR}$ is to correct a deviation of air-fuel ratio accompanied by a canister purge conducted during a previous engine operation but on the other hand this renewal of $K_{LR}$ results in adverse effects caused by substantial deviations of air-fuel ratio such as in startability and emissions at an engine start with an open control. The steps as to how to correct a deviation of air-fuel ratio is explained as follows.

Figure 1:
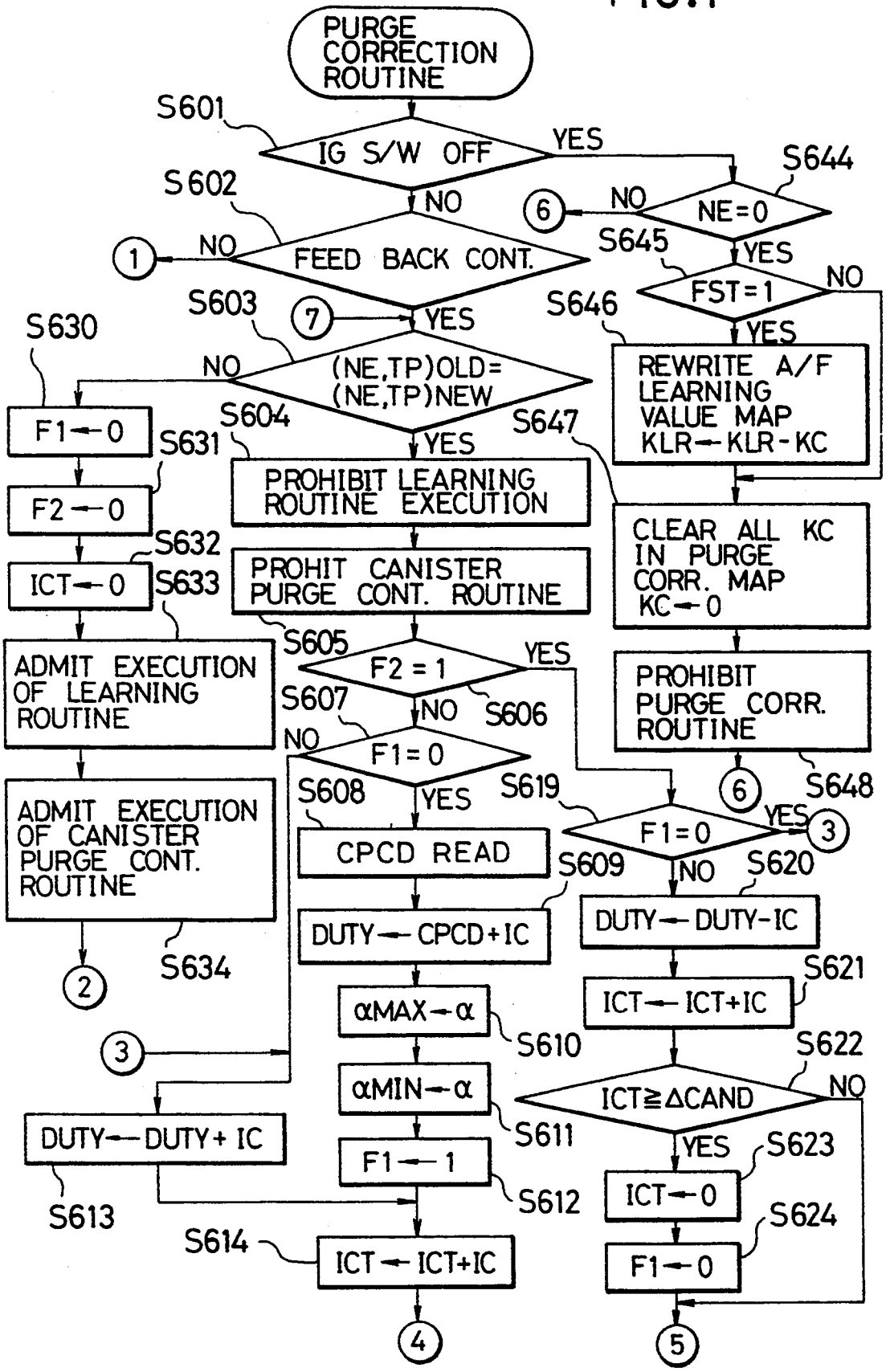
FIG. 1 is a flowchart 1 showing a purge correction routine of learning value.
Figure 2:
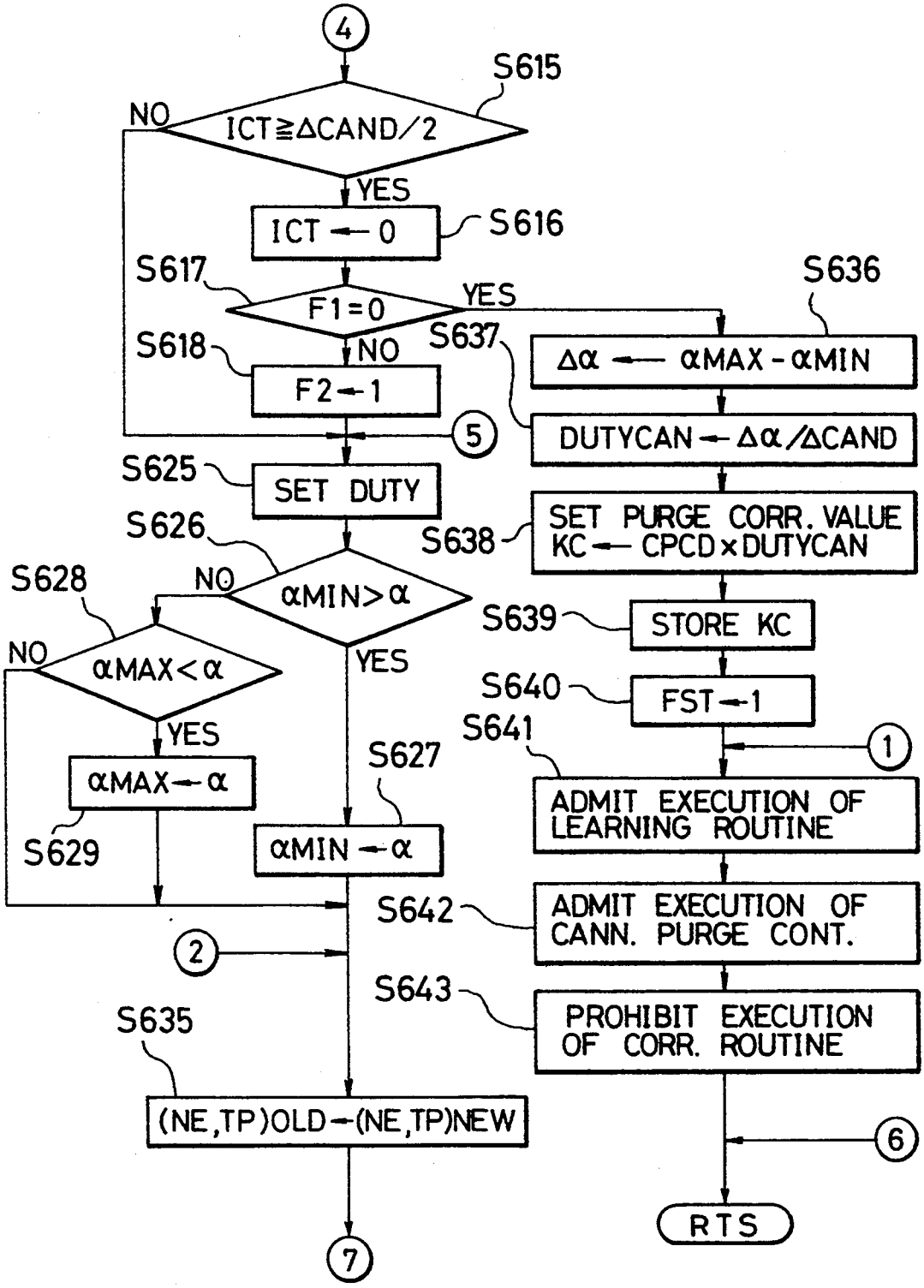
FIG. 2 is a flowchart 2 showing a purge correction routine of learning value.
Figure 7:
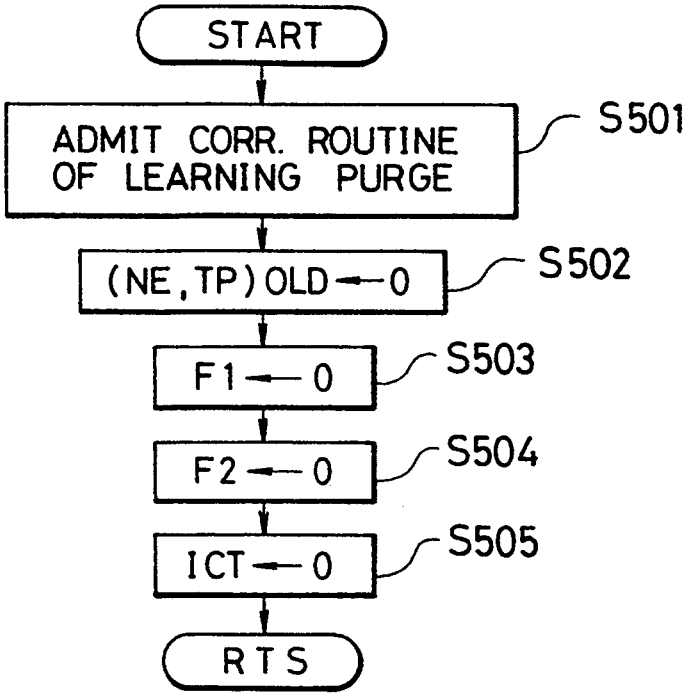
FIG. 7 is a flowchart showing a routine admitting purge correction.

In a purge correction routine as shown in FIG. 1 and FIG. 2, the deviation of the air-fuel ratio learning value $K_{LR}$ caused by canister purge is calculated and the air-fuel ratio learning value map $TB_{KLR}$ is rewritten after an engine stop. The purge correction routine is executed only when a purge correction admission routine as illustrated in FIG. 7 is carried out.

The purge correction admission routine is carried out at a relatively elongated predetermined interval. If a purge correction is admitted at a step S501, an area data $(N_E, T_p)_{OLD}$ in the steady state judging map MT is cleared ($(N_E, T_p)_{OLD}=0$) and an addition flag F1 is cleared (F1=0) at a step S503.

Figure 11:
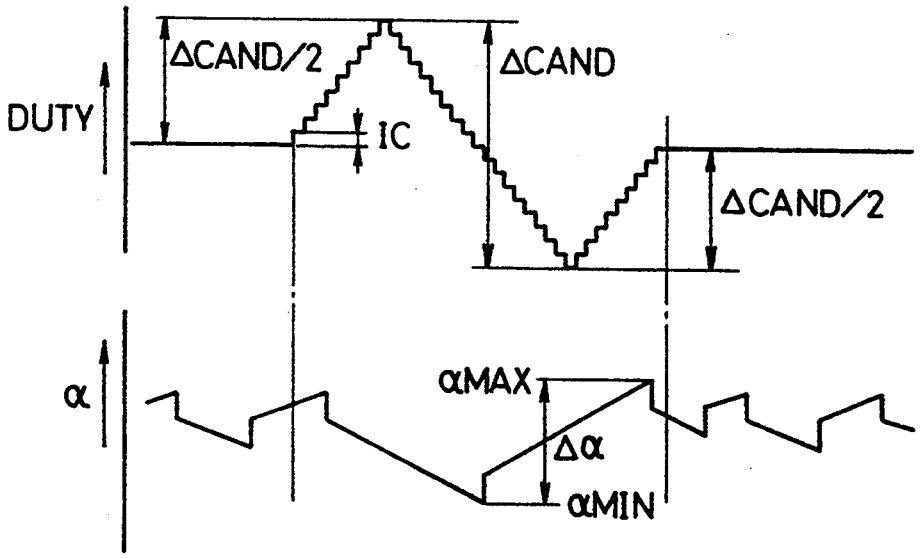
FIG. 11 is a graphical illustration indicating variations of a feedback correction coefficient against variations of purge control duty.

The addition flag F1 is, as shown in FIG. 11, one for ordering to increase a purge control duty DUTY by an $I_C$ (purge control integral constant) when checking a change of an air-fuel ratio feedback correction coefficient $\alpha$ by changing the purge control duty DUTY for a specified time.

At the next step S504 a subtraction flag F2 is cleared (F2=0). The subtraction flag F2 is one for ordering to decrease a purge control duty DUTY by the $I_C$ as in FIG. 11.

Further at a step S505 an $I_{CT}$ (an integrating value of purge control integral constants) is cleared ($I_{CT}=0$) and then this routine terminates.

If both F1 and F2 are equal to 0, a purge control duty DUTY is ordered to be initialized. When the purge control duty DUTY has been initialized, F1 is set to 1 and a purge control integral constant $I_C$ is added to the purge control duty DUTY. In $\frac{1}{4}$ 4 cycle after the purge control duty DUTY is increased, the above subtraction flag F2 is set to 1. After $\frac{1}{4}$ cycle, the purge control duty DUTY is reduced by the purge control integral constant $I_C$. Further in $\frac{3}{4}$ cycle, the above addition flag F1 is set to 0 and the purge control duty DUTY is increased by the purge control integral constant $I_C$ again, thus 1 cycle is finished.

Once the purge correction routine is permitted to be carried out by the purge correction admission routine, this routine, as shown in FIG. 1 and FIG. 2, is executed at a predetermined time interval.

Referring to FIG. 1, at a step S601, it is judged whether or not an ignition key switch 50 is turned off. If the ignition key switch 50 is turned off, the process is diverted to a step S644 and if it is turned on and at the same time an engine is being operated, the process goes to a step S602.

At the step S602, it is judged whether the flow of control is in the feedback control or not. In case where the flow is not in the feedback control, the process goes to a step S641 where the aforementioned learning routine is permitted to be carried out and at a step S642 the aforementioned canister purge control routine is permitted to be executed.

At a step S643 an execution of the purge correction routine is prohibited and the routine terminates. On the other hand, if it is judged that the flow of control is in the feedback control, the process steps from the above step S602 to a step S603 where it is judged whether or not the present area data $(N_E, T_p)_{NEW}$ in the steady state judging matrix MT is the same as the previous area data $(N_E, T_p)_{OLD}$ which is read from the RAM 44.

If $(N_E, T_p)_{NEW}$ differs from $(N_E, T_p)_{OLD}$ (this means the first execution since an interruption is permitted), or if the operational area at the present execution of the routine differs from the one at the previous execution of the routine (this means a non-steady or changing state), then the process goes from the step S603 to a step S630.

Following steps S630, S631 and S632, an addition flag F1, a subtruction flag F2 and an integrating value of integral constants $I_{CT}$ are cleared respectively (F1=0, F2=0 and $I_{CT}=0$) and the process steps to a step S633 where a learning routine is permitted to be carried out and at a step S634 a canister purge control routine is permitted to be executed.

After that, stepping to a step S635, the previous area data $(N_E, T_p)_{OLD}$ is updated with the present area data $(N_E, T_p)_{NEW}$ and the process passes to a step S603. Then the steps are repeated after the step S603.

If $(N_E, T_p)_{NEW}$ is the same as $(N_E, T_p)_{OLD}$ at the step S603, namely, the operational area at the present execution of the routine is the same as the one at the previous execution of the routine (this means a steady state), the process goes from the step S603 to a step S604. At the step S604, an execution of the learning routine is prohibited in order that when a change of air-fuel ratio is checked by increasing or decreasing the purge control duty DUTY the changed air-fuel ratio is not learned erroneously.

Further at the next step S605, an execution of the canister purge control routine is prohibited in order that a purge control duty DUTY is not controlled by the canister purge control routine.

Next, at a step the subtraction flag F2 is looked up. If F2 is equal to 0, that is to say, the purge control duty DUTY is not yet reduced by an integral constant $I_C$, the addition flag F1 is looked up at a step S607.

At the step S607, in case where F1 is equal to 1 with a state of F2=0, this case indicates that a purge control duty DUTY has been initialized at the previous routine, so that the purge control duty DUTY is increased by an integral constant $I_C$ at a step S613 and the process passes to a step S614.

On the other hand, at the above step S607, where F1 is equal to 0, since this case is where both addition flag F1 and subtraction flag F2 are cleared or initialized, the process steps from the step 607 to the step S608 where the basic duty CPCD presently determined is read from the RAM 44.

Further at the next step S609, a purge control integral constant $I_C$ is added to the above CPCD (DUTY=CPCD+$I_C$), thus the purge control duty DUTY is initialized.

Next, at a step S610, for the time being, the maximum and minimum values of the air-fuel feedback correction coefficient $\alpha$ are determined as $\alpha_{MAX}$ and $\alpha_{MIN}$, respectively, according to the present value of $\alpha$. These values are stored in the RAM 44 ($\alpha=\alpha_{MAX}$, $\alpha=\alpha_{MIN}$) and at a step S612 the addition flag F1 is set to 1.

At a step S614 the present purge control integral constant $I_C$ is added to the previous integrated value $I_{CT}$ and the $I_{CT}$ is renewed ($I_{CT}=I_{CT}+I_C$).

At the next step S615 it is judged whether or not this $I_{CT}$ is above $\frac{1}{2}$ of a predetermined value ΔCAND. The ΔCAND is a span of change for the purge control duty DUTY in one cycle, as illustrated in FIG. 1 and the half ($\frac{1}{2}$) of ΔCAND is assumed to be a change of DUTY corresponding to $\frac{1}{4}$ cycle.

Accordingly, when the integrated value $I_{CT}$ which is renewed at each execution of this purge correction routine reaches $\frac{1}{2}$ of the above predetermined value ΔCAND, it is prescribed that $\frac{1}{4}$ cycle has been finished. After $\frac{1}{4}$ cycle the purge control duty DUTY is continued to be subtracted by an $I_C$ each time the purge correction routine is carried out until $\frac{3}{4}$ cycle and then after $\frac{3}{4}$ cycle the purge control duty DUTY is continued to be added by an $I_C$ again until 1 cycle is finished.

Therefore, at a step S615 in FIG. 2, in case where $I_{CT}$ is smaller than ΔCAND/2, the purge control duty DUTY is on the way of being changed towards $\frac{1}{4}$ cycle from an initial condition and in this case the process passes to a step S625 from the step S615.

In case where $I_{CT}$ is equal to or larger than ΔCAND/2, this case shows that the cycle of DUTY change reaches $\frac{1}{4}$ cycle and the process goes from the above step S615 to the next step S616 where $I_{CT}$ is cleared ($I_{CT}=0$) and further at a step S617 an addition flag F1 is looked up.

If F1 is equal to 1 (i.e. F2=0 and F1=1), this case indicates that the cycle of DUTY change reaches $\frac{1}{4}$ cycle after the increasing process following initialization, so that the subtraction flag F2 is set to 1 (F2=1) at a step S618 in order to reduce the purge control duty DUTY and the process goes to steps after S625 where a maximum and minimum values of the air-fuel ratio feedback correction coefficient α are detected.

If F1 is equal to 0 (i.e., F2=1 and F1=0), this case indicates that the cycle of DUTY change reaches 1 cycle after processes, increasing to reducing and again reducing to increasing, so that the process is diverted to steps after S636 where a deviation of the air-fuel ratio learning value $K_{LR}$ is calculated.

On the other hand, at the above step S606, in case where F2 is equal to 1, the process is diverted to a step S619 where an addition flag F1 is looked up. If F1 is equal to 1 (i.e., both F1 and F2 are set to 1), since this case indicates that the purge control duty DUTY has been continued to be increased for $\frac{1}{4}$ cycle, the purge control duty DUTY is needed to be reduced at steps following S620. Namely, at the step S620, the present purge control duty DUTY is reduced as much as an $I_C$ (DUTY=DUTY−$I_C$) and at the next step S621 the integrated value of integral constants $I_{CT}$ is renewed ($I_{CT}=I_{CT}+I_C$), thus the process goes to a step S622.

At a step S622, it is judged whether or not the integrated value of integral constants $I_{CT}$ reaches a predetermined value ΔCAND, or a span of change for the purge control duty DUTY. IF $I_{CT}$ is smaller than ΔCAND, the process passes to a step S625 and if $I_{CT}$ is equal to or larger than ΔCAND, the integrated value $I_{CT}$ is cleared at a step S623 ($I_{CT}=0$).

At the next step S624 the addition flag F1 is set to 0 (F1=0) and the process passes to a step S625.

On the other hand, if F1 is equal to 0 at the above-mentioned step S619 (i.e., F2=1 and F1=0), since this case indicates that the purge control duty DUTY has been continued to be decreased for $\frac{3}{4}$ cycle, the process passes to a step S613 to increase the DUTY.

At steps following a step S625, the maximum and minimum values of an air-fuel ratio feedback correction coefficient are detected.

As shown in FIG. 11, when the purge control duty DUTY goes up from the initial condition, an opening of the CPC valve is increased to allow more fuel vapor to be purged from the canister 23 to the engine, however, the air-fuel feedback correction coefficient α is going down (becoming lean) after a time lag. In a while after the purge control duty DUTY is converted to the decremental direction at $\frac{1}{4}$ cycle and the opening of the CPC valve is decreased to allow less fuel vapor to be purged from the canister 23 to the engine, the air-fuel feedback correction coefficient α is turned to a rise (becoming rich) at near $\frac{1}{2}$ cycle.

At a step S625, the present purge control duty DUTY is transmitted to the CPC valve via a driver 52 and an opening of the CPC valve corresponding to this duty value is determined.

At the next step S626, it is judged whether or not the present value of the air-fuel ratio feedback correction coefficient α is compared with a minimum value $\alpha_{MIN}$ stored in the RAM 44.

If $\alpha_{MIN}$ is greater than α, the present coefficient α is set to MIN ($\alpha=\alpha_{MIN}$) at a step S627 and this new $\alpha_{MIN}$ is stored in the RAM 44, thus the process passes to the step S603 via the aforementioned step S635.

If $\alpha_{MIN}$ is equal to or smaller than α, the process is diverted to a step S628 where the present coefficient α is judged larger or not than $\alpha_{MAX}$ stored in the RAM 44. If $\alpha_{MAX}$ is equal to or larger than α, the process passes to a step S635 and if $\alpha_{MAX}$ is smaller than α, the present coefficient α is set to $\alpha_{MAX}$ ($\alpha=\alpha_{MAX}$) at a step S629. This new $\alpha_{MAX}$ is stored in the RAM 44 and the process passes to the step S603 via S635.

At steps following a step S636, a deviation of an air-fuel ratio learning value $K_{LR}$ is calculated.

At the step S636, the span of change for the air-fuel ratio feedback correction coefficient α denoted as Δα is calculated according to $\alpha_{MAX}$ and $\alpha_{MIN}$ of the air-fuel ratio feedback correction coefficient α which are stored in the RAM 44 ($\Delta\alpha=\alpha_{MAX}-\alpha_{MIN}$). At a step S637, a change rate of α per unit duty DUTYCAN is obtained by dividing a Δα by a predetermined value ΔCAND (DUTYCAN=Δα/ΔCAND) and then the process goes to a step S638.

At the step S638, a deviation of the air-fuel ratio learning value $K_{LR}$ by a canister purge is calculated. The deviation of $K_{LR}$ is denoted hereafter as a purge correction coefficient $K_C$ which is derived through multiplying the basic duty ratio CPCD by the above change rate of α per unit duty DUTYCAN obtained at the step S637 ($K_C$=CPCD×DUTYCAN).

Further, the process goes to a step S639 where the above purge correction coefficient $K_C$ is stored in an address of the purge correction value map $TB_{KC}$ which is specified by the engine speed $N_E$ and the basic fuel injection amount $T_p$ and the previously calculated value of $K_C$ is updated with this new purge correction coefficient $K_C$. At an engine start KC is initialized ($K_C=0$). The purge correction value map $TB_{KC}$ is formed in the RAM 44 with parameters of an engine speed $N_E$ and a basic fuel injection amount $T_p$ as indicated in FIG. 12. Each address of the map $TB_{KC}$ corresponds to a respective address of the stationary state judging matrix MT and the air-fuel ratio learning value map $TB_{KLR}$.

Then, from the step S639 the process goes to a step S640 where a learning value correction judging flag $F_{ST}$ is set to 1 ($F_{ST}=1$). The flag $F_{ST}$ is cleared ($F_{ST}=0$), when the system is initialized. Since the flag $F_{ST}$ set to 1 when the purge correction coefficient $K_C$ is determined, it is possible to judge that the purge correction coefficient $K_C$ has been established at least more than once by looking up this learning value correction judging flag $F_{ST}$.

Next, at steps S641 and S642, it is admitted that a learning routine and canister purge routine are executed respectively and at a step S643 this purge correction routine is prohibited to be carried out, thus the program returns to the main routine.

On the other hand, at a step S601 as indicated in FIG. 1, in case where an ignition key switch 50 is turned off, the process goes to a step S644. In this case, although the ignition switch 50 is turned off, a self-shut relay 48*b* is kept "ON" during a set time after the ignition key switch "OFF" by a self-shut relay control routine as shown in FIG. 8, so that electric power is continued to be supplied to the ECU 41, whereby this purge correction routine following a step S644 is carried out.

Figure 8:
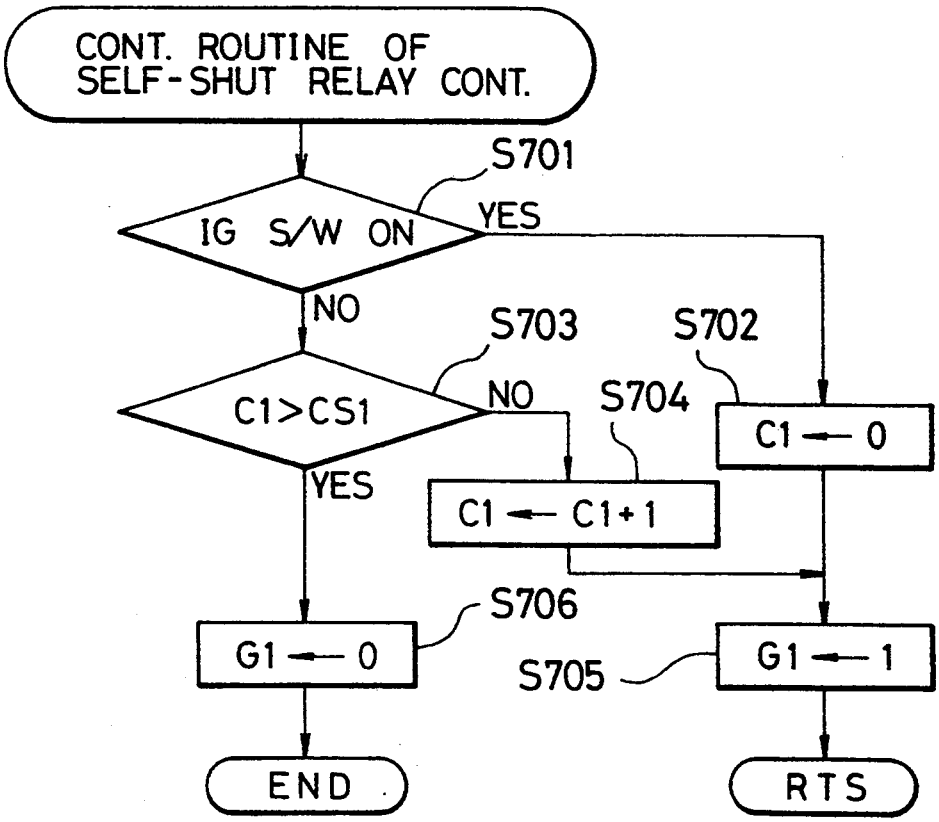
FIG. 8 is a flowchart indicating a control routine of the self-shut relay.

FIG. 8 indicates a self-shut relay control routine by which a self-shut relay is kept on.

At a step S701 it is judged whether or not the ignition switch 50 is tuned on. If the ignition is "ON", a count number C1 for counting an elapsed time after the ignition "OFF" is cleared (C1=0) at a step S702, then the process goes to a step S705 where an output value G1 of the I/O port for the self-shut relay 48*b* is set to 1 (G1=1) in order to switch the self-shut relay 48*b* on, thus the routine returns to the main routine. If the ignition is "OFF" at the step S701, the process goes to a step S703 where it is judged whether or not the count number reaches a predetermined number CS1 corresponding to a set elapsed time (for example 3 minutes).

In case where C1 is equal to or smaller than CS1, the process is diverted from the step S703 to a step S704 where the count number C1 is counted up by 1 (C1=C1+1) and at the next step S705 as mentioned above, G1 is set to 1 so as to hold a power supply to the ECU 41.

In case where is larger than CS1, the process steps to a step S706 at which G1 is set to 0 so as to turn the self-shut relay 48*b* off i.e., to turn off a power supply to the ECU 41. Therefore, the purge correction routine as shown in FIG. 1 is continued to be executed for a given period even after an ignition key switch is turned off. That is to say, in this purge correction routine, in case where an ignition key switch is judged to be "OFF" at the step S601, the process is diverted to a step S644 where it is judged whether an engine is in standstill (engine speed $N_E=0$).

If $N_E$ is equal to 0, a learning value correction judging flag $F_{ST}$ is looked up at the next step S645.

At the step S645, in case where the flag $F_{ST}$ is equal to 0, i.e., a purge correction coefficient $K_C$ has not been established after an engine start, the process passes to a step S647.

In case where the flag $F_{ST}$ is equal to 1, i.e. a purge correction coefficient $K_C$ has been established after an engine start, at a step S646 an air-fuel ratio learning value $K_{LR}$ stored in an address of the air-fuel ratio learning value map $TB_{KLR}$ is subtracted by a purge correction coefficient $K_C$ stored in a corresponding address of the purge correction value map $TB_{KC}$ and the previous data of $K_{LR}$ is updated with this newly obtained $K_{LR}$ ($K_{LR}=K_{LR}-K_C$).

These processes are performed for each corresponding address of above both maps, thus all data of $K_{LR}$ in the air-fuel ratio learning value map $TB_{KLR}$ are rewritten.

Further at the next step S647, all data of the purge correction coefficient $K_C$ in the purge correction value map $TB_{KC}$ are cleared ($K_C=0$) and an execution of the purge correction routine is prohibited at a step S648, thus the process returns to the main routine.

By means of this, the air-fuel ratio learning value $K_{LR}$ is rendered back to an original learning value by canceling a deviation in air-fuel ratio learning values derived from a canister purge.

Therefore, in an open loop control at an engine start, it becomes possible that air-fuel ratio is kept at an appropriate value and also the engine startability is improved. Furthermore, since an effect of the canister purge can be eliminated from the air-fuel ratio learning control, a deviation of air-fuel ratio which comes from variations or secular changes in components of the air induction system such as an air flow sensor and of the fuel system such as a fuel injector is rapidly corrected and an original learning value is effectively employed in the air-fuel control. As a result of this, it becomes possible to improve emissions performance and controllability of the system.

I claim:

1. A system for controlling an air-fuel ratio of an internal combustion engine having an apparatus for controlling an amount of fuel vapor purged into said engine from a canister which adsorbs said fuel vapor from a fuel tank, the system comprising:

detecting means for detecting an engine operating condition;

calculating means for calculating a basic fuel injection amount according to said engine operating condition;

setting means responsive to said engine operating condition for setting a feedback coefficient;

learning means responsive to said feedback coefficient and said operating condition for learning an air-fuel ratio learning value;

deciding means responsive to said basic fuel injection amount and said air-fuel ratio learning value for deciding upon a decided fuel injection amount;

judging means responsive to said engine operating condition for judging whether or not the engine is in a steady running condition;

changing means for changing said amount of fuel vapor purged from the canister at a predetermined rate when said engine is running in said steady running condition;

determining means for determining how said feedback coefficient varies when said amount of fuel vapor purged from the canister is changed at said predetermined rate and providing a variation value indicative thereof;

computing means responsive to said variation value of said feedback coefficient as determined by said determining means for computing a purge correction value;

rewriting means for rewriting said air-fuel ratio learning value according to said purge correction value so as to have a rewritten air-fuel ratio learning value when said engine is stopped; and memory means for memorizing the rewritten air-fuel ratio learning value such that the rewritten air-fuel ratio learning value is available after the engine is stopped for providing an improved air-fuel ratio upon a restarting of the engine.

2. The system according to claim 1, further comprising:

holding means for maintaining electrical power supply to the system for a specified time after the engine has stopped so as to provide for rewriting of said air-fuel ratio learning value by said rewriting means.

3. A method for controlling an air-fuel ratio of an internal combustion engine having an injector, a canister for absorbing fuel vapor from a fuel tank, a fuel injection control system for controlling an amount of fuel to be injected from said injector based on an air-fuel ratio feedback correction value determined by an air-fuel ratio feedback correction system in response to a signal from an oxygen sensor equipped at an exhaust portion of said engine, and on a learning value determined by a learning value determination system for use in compensating for drift of said air-fuel ratio feedback correction value, and a purge control system for controlling a fuel vapor purge quantity purged from said canister to an intake of said engine based on an operating condition of said engine, the method comprising:

prohibiting learning of said learning value for a predetermined time period;

changing said fuel vapor purge quantity at a predetermined rate during said predetermined time period;

detecting how said air-fuel ratio feedback correction value varies while said fuel vapor purge quantity is changed at said predetermined rate and obtaining a variation value indicative thereof;

calculating a deviation of said learning value caused by said changing of said fuel vapor purge quantity based upon said variation value;

correcting said learning value based upon said deviation so as to have a corrected learning value when said engine is turned off; and storing the corrected learning value such that the corrected learning value is available after said engine is turned off for providing an improved air-fuel ratio upon a restarting of said engine.

4. The method according to claim 3, further comprising:

detecting operating conditions of said engine; and determining whether said engine is in a steady state in response to said operating conditions prior to said prohibiting step, said prohibiting step being performed when said engine is in said steady state.

5. The method according to claim 3, wherein said fuel vapor purge quantity is changed by gradually changing a purge control duty for a purge valve equipped between said canister and said intake.

6. The method according to claim 5, wherein said purge control duty is changed within a predetermined range.

7. The method according to claim 6, wherein said calculating step comprises:

calculating a changing rate of said air-fuel ratio feedback correction value by dividing said variation value by said predetermined range; and calculating said deviation of said learning value by multiplying a predetermined basic duty ratio for said purge valve by said changing rate.

8. The method according to claim 3, wherein said variation value is represented by a difference between maximum and minimum values of said air-fuel ratio feedback correction value during said predetermined time period.

9. A system for controlling an air-fuel ratio of an internal combustion engine having an injector, a canister for absorbing fuel vapor from a fuel tank, an air-fuel ratio feedback correction system for determining an air flow ratio feedback correction value, a learning value determination system for determining a learning value for compensation for drift of said air-fuel ratio feedback correction value, a fuel injection control system for controlling an amount of fuel to be injected from said injector based on said air-fuel ratio feedback correction value, in response to a signal from an oxygen sensor equipped with an exhaust portion of said engine, and on said learning value, and a purge control system for controlling a quantity of fuel vapor to be purged from said canister to an intake of said engine based on operating conditions for said engine, the system comprising:

prohibiting means for prohibiting learning of said learning value for a predetermined time period;

changing means for changing said fuel vapor purge quantity at a predetermined rate during said predetermined time period;

detecting means for detecting how said air-fuel ratio feedback correction value varies while said fuel vapor purge quantity is changed at said predetermined rate and providing a variation value indicative thereof;

calculating means for calculating a deviation of said learning value caused by said changing of said fuel vapor purge amount based upon said variation value;

correcting means for correcting said learning value based upon said deviation so as to have a corrected learning value when said engine is turned off; and storing the corrected learning value such that the corrected learning value is available after said engine is turned off for providing an improved air-fuel ratio upon a restarting of the engine.

10. The system according to claim 9, further comprising:

operation detecting means for detecting operating conditions of said engine; and determining means for determining whether said engine is in a steady state in response to said operating conditions before said prohibiting means prohibits said learning, said prohibiting means prohibiting learning when said engine is in said steady state.

11. The system according to claim 9, wherein said fuel vapor purge quantity is adapted to be changed by gradually changing a purge control duty for a purge valve equipped between said canister and said intake.

12. The system according to claim 11, wherein said purge control duty is adapted to be changed within a predetermined range.

13. The system according to claim 12, wherein said calculating means comprises;

computing means for computing a changing rate of said air-fuel ratio feedback correction value by dividing said variation value by a predetermined range; and calculating means for calculating said deviation of said learning value by multiplying a predetermined basic duty ratio for said purge value by said changing rate.

14. The system according to claim 9, wherein said variation value is adapted to be represented by a difference between maximum and minimum values of said air-fuel ratio feedback correction value during said predetermined time period.

* * * * *